US008573412B2

(12) United States Patent
Schwartz et al.

(10) Patent No.: US 8,573,412 B2
(45) Date of Patent: Nov. 5, 2013

(54) MATERIAL HOLDER

(75) Inventors: Lily Schwartz, Rogers, MN (US); Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 185 days.

(21) Appl. No.: 13/164,548

(22) Filed: Jun. 20, 2011

(65) Prior Publication Data

US 2012/0318760 A1 Dec. 20, 2012

(51) Int. Cl.

| | |
|---|---|
| ***A47F 1/12*** | (2006.01) |
| ***A47F 5/16*** | (2006.01) |
| ***A47B 57/42*** | (2006.01) |
| ***A47B 57/52*** | (2006.01) |

(52) U.S. Cl.

USPC ..... 211/59.2; 211/119.003; 211/133.3; 211/193

(58) Field of Classification Search

USPC ..... 211/59.2, 85.29, 75, 113, 119.003, 211/87.01, 193, 90.01, 86.01, 90.02, 90.04, 211/128.1, 126.1, 133.3, 133.4, 126.16, 211/135, 134, 126.5, 126.13, 11, 88.01; 248/241–243; 108/108, 29, 42, 30

See application file for complete search history.

(56) References Cited

U.S. PATENT DOCUMENTS

| | | | | | |
|---|---|---|---|---|---|
| 1,164,966 | A | * | 12/1915 | Sturgis | 312/232 |
| 1,610,014 | A | * | 12/1926 | Koch | 206/135 |
| 1,742,069 | A | | 12/1929 | Greenwald et al. | |
| 1,857,522 | A | * | 5/1932 | Ungeheuer | 220/8 |
| 2,138,418 | A | * | 11/1938 | Fahrne | 211/14 |
| 2,239,369 | A | * | 4/1941 | Nauert | 211/14 |
| 2,275,703 | A | * | 3/1942 | Trester et al. | 222/160 |
| D162,122 | S | * | 2/1951 | Broeren | D6/518 |
| 2,588,618 | A | * | 3/1952 | Di Renzo | 312/49 |
| 2,639,040 | A | * | 5/1953 | Tapley | 211/119.003 |
| 2,673,601 | A | * | 3/1954 | Fischer et al. | 312/246 |
| 2,852,327 | A | * | 9/1958 | Mason | 312/45 |
| 2,915,162 | A | * | 12/1959 | Umstead | 193/27 |
| 3,320,690 | A | | 5/1967 | Forsburg | |
| 3,414,093 | A | | 12/1968 | Chostner | |
| 3,712,696 | A | * | 1/1973 | McDonnell | 312/245 |
| 4,201,291 | A | | 5/1980 | Davidson | |
| 4,265,038 | A | | 5/1981 | Crosslen | |
| 4,700,849 | A | * | 10/1987 | Wagner | 211/41.2 |
| 4,896,779 | A | | 1/1990 | Jureckson | |
| 4,982,852 | A | | 1/1991 | Johansen | |
| 5,036,990 | A | * | 8/1991 | Verchere | 211/85.29 |
| 5,205,630 | A | * | 4/1993 | Welch et al. | 312/249.11 |
| 5,323,917 | A | * | 6/1994 | Johnson et al. | 211/74 |

(Continued)

OTHER PUBLICATIONS

Office Action from Canadian Patent Application No. 2,765,586, mailed Jan. 17, 2013 (3 pages).

*Primary Examiner* — Jennifer E Novosad

(74) *Attorney, Agent, or Firm* — Leanne Taveggia Farrell; Westman, Champlin & Koehler, P.A.

(57) ABSTRACT

A retail display apparatus includes a mounting frame, a product support portion, and a fastening element. The mounting frame has a mounting surface that is mounted to a shelf and at least two sidewalls that extend from the mounting surface. The product support portion is positioned between the side walls of the mounting frame and has a top surface at an angle to the mounting surface. The fastening element is attached to a bottom surface of the product support portion and is adapted to engage a second fastening element attached to a product.

14 Claims, 7 Drawing Sheets

(56) References Cited

U.S. PATENT DOCUMENTS

| | | | | | |
|---|---|---|---|---|---|
| 5,333,745 | A | * | 8/1994 | Lehmann | 211/88.01 |
| 5,397,006 | A | * | 3/1995 | Terrell | 211/88.01 |
| D369,708 | S | * | 5/1996 | Breen | D6/515 |
| 5,626,407 | A | * | 5/1997 | Westcott | 312/408 |
| 5,647,485 | A | | 7/1997 | Verrangia | |
| 5,722,557 | A | * | 3/1998 | Smith | 220/476 |
| 5,743,438 | A | * | 4/1998 | Sokolnicki | 222/181.1 |
| 5,799,427 | A | | 9/1998 | Abramson et al. | |
| 6,321,475 | B1 | | 11/2001 | Glanz | |
| 6,484,429 | B1 | | 11/2002 | Przylucki | |
| 7,124,988 | B1 | | 10/2006 | Duffy et al. | |
| 7,185,762 | B2 | | 3/2007 | Ferris | |
| 7,204,376 | B2 | | 4/2007 | Richardson et al. | |
| 7,487,611 | B2 | | 2/2009 | Robb | |
| 7,527,158 | B2 | * | 5/2009 | Gainer et al. | 211/119.005 |
| 7,882,969 | B2 | | 2/2011 | Gerstner et al. | |
| 2001/0035368 | A1 | | 11/2001 | Carr | |
| 2004/0065580 | A1 | | 4/2004 | Chapman | |
| 2005/0044765 | A1 | | 3/2005 | Ahlund et al. | |
| 2007/0056878 | A1 | | 3/2007 | Walsh et al. | |
| 2007/0090073 | A1 | | 4/2007 | Blum et al. | |
| 2009/0134105 | A1 | | 5/2009 | Rysenbry et al. | |
| 2010/0264783 | A1 | | 10/2010 | Tam | |

* cited by examiner

MATERIAL HOLDER

BACKGROUND

In retail environments, products that are to be purchased are often packaged to protect them from damage. For some products, such as bedding, guests may want to feel the product to determine its firmness and resilience. However, the packaging around the products often prevents the guest from touching the product.

The discussion above is merely provided for general background information and is not intended to be used as an aid in determining the scope of the claimed subject matter.

SUMMARY

A retail display apparatus includes a mounting frame, a product support portion, and a fastening element. The mounting frame has a mounting surface that is mounted to a shelf and at least two sidewalls that extend from the mounting surface. The product support portion is positioned between the side walls of the mounting frame and has a top surface at an angle to the mounting surface. The fastening element is attached to a bottom surface of the product support portion and is adapted to engage a second fastening element attached to a product.

A retail display unit includes a shelving unit, an attachment structure and a product support structure. The shelving unit has at least one shelf and the shelf has a top surface and a bottom surface with at least one opening between the top surface and the bottom surface. The attachment structure has a top portion and two side portions extending down from the top portion so that the entirety of the two side portions is below the shelf. The attachment structure is mounted to the bottom surface of the shelf by at least one fastener passing through at least one of the openings in the shelf. The product support structure is positioned between the two side portions of the attachment structure and has a top panel with a front end and a back end wherein the front end of the top panel is lower than the back end of the top panel and wherein the front end of the top panel is unobstructed.

A method of displaying samples includes mounting a holder to a bottom of a shelf by passing portions of mounting fasteners through holes in the holder and holes in the shelf. A sample is placed on an inclined plane of the holder such that a front of the sample extends past a front of the holder. The sample is attached to the holder by engaging a fastener positioned on a bottom surface of the inclined plane with a fastener positioned on an end of a strap connected to the sample.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
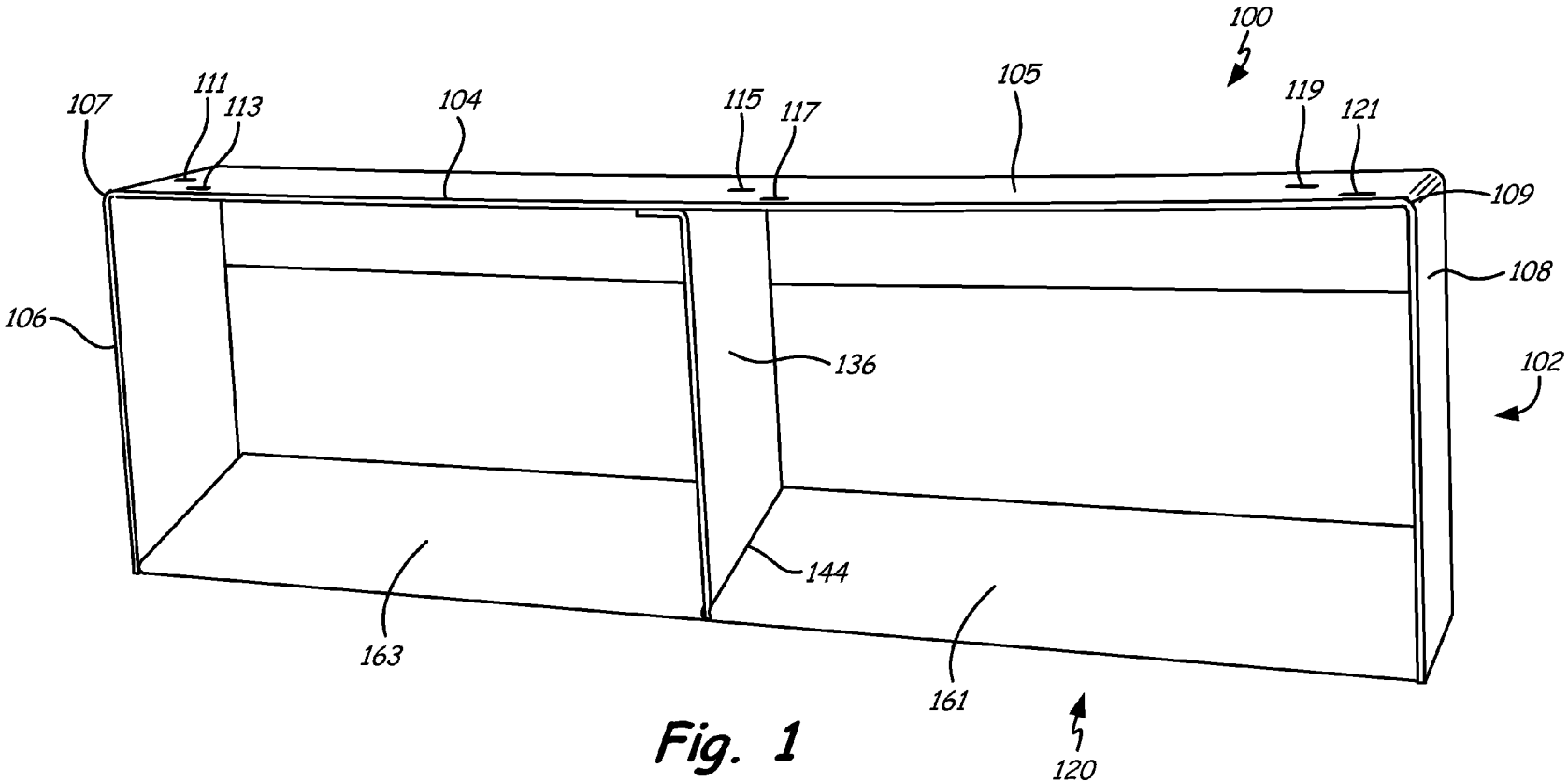
FIG. 1 is a front perspective view of a retail display apparatus, in accordance with one embodiment.
Figure 2:
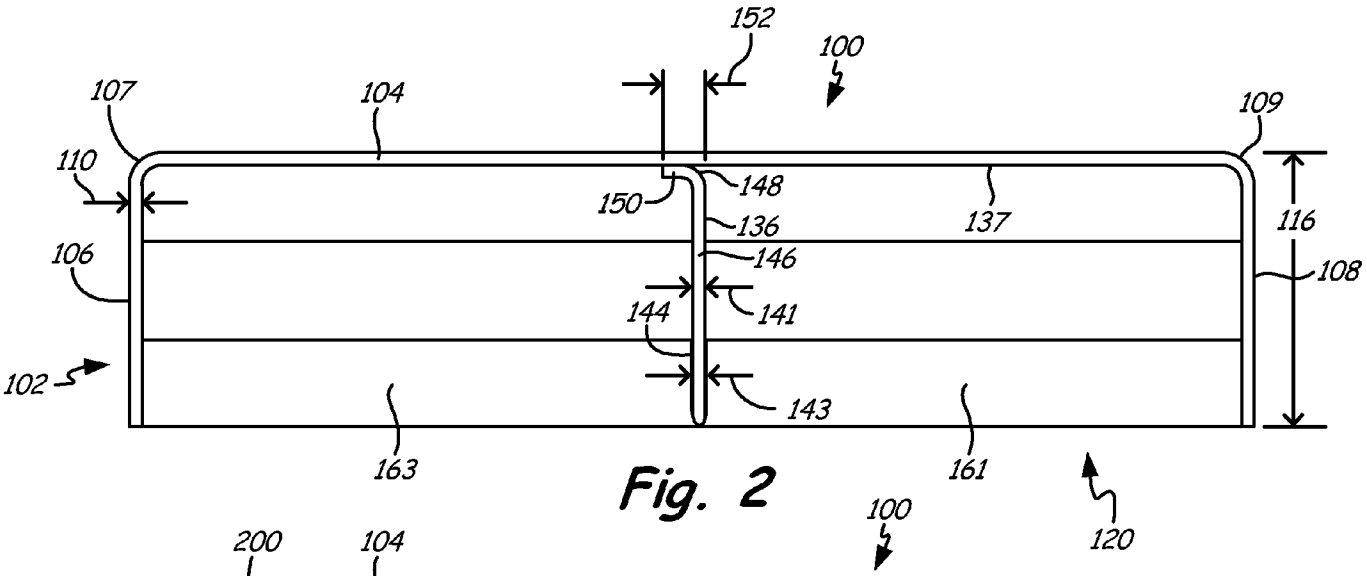
FIG. 2 is a front view of the retail display apparatus of FIG. 1.

The embodiments described below provide a holder for holding product samples such as foam, for example. The holder is designed to be mounted beneath a shelf in a retail environment to give guests access to product samples without occupying valuable top surface shelf space and without the holder itself extending out into an aisle of the store.

FIGS. 1-7 provide a perspective, front, back, top, side and side cross-sectional views, respectively, of one embodiment of a retail display apparatus or holder 100.

Retail display apparatus 100 includes a mounting frame or attachment structure 102 having a top portion 104 with a mounting surface 105 adapted to mount the retail display apparatus to a shelf and at least two side walls or portions 106 and 108 extending down from the top portion 104. In accordance with one embodiment, mounting frame 102 is a single piece of material that has been bent at two corners 107 and 109 which are positioned between top portion 104 and side walls 106 and 108, respectively. In accordance with one embodiment, mounting frame 102 has a thickness 110 of approximately 0.118 inches (0.3 cm) and is made of styrene. Those skilled in the art will recognize that other plastics or other materials such as steel may be used in place of styrene. In accordance with one embodiment, top portion 104 has a width 112 of approximately 23.81 inches (60.47 cm) and side walls 106 and 108 have a height 116 of approximately 7.31 inches (18.57 cm), for example. Top portion 104 and side walls 106 and 108 have a depth 114 of approximately 3.50 inches (8.89 cm), for example.

Top portion 104 has a collection of attachment openings 111, 113, 115, 117, 119, and 121 that are adapted to accept fasteners to fasten top portion 104 to a shelf. In accordance with one embodiment, attachment openings 111, 113, 115, 117, 119, and 121 are oblong openings that make it easier to align the attachment openings with openings in the shelves.

A base structure 120 is positioned between the at least two side walls 106 and 108. Base structure 120 has a base portion or bottom panel 122, a product support portion/structure or top panel 124, and a curved portion 126 between base portion 122 and product support portion 124. Product support portion 124 has a top surface 128 with a front end 130 that is lower than a back end 132 such that top surface 128 is at an angle 134 to base portion 122. Since base portion 122 is parallel to mounting surface 105 of mounting frame 102, top surface 128 is also at angle 134 to mounting surface 105. In accordance with one embodiment, angle 134 is approximately 19 degrees with back end 132 of top surface 128 a height 129 above a bottom surface 131 of base portion 122 and front end 130 is a height 133 above bottom surface 131. In accordance with one embodiment, height 129 is approximately 1.21 inches (3.073 cm) and height 133 is approximately 0.236 inches (0.599 cm).

Front end 130 of product support portion 124 is unobstructed in that there is no wall or other obstruction extending upward at front end 130. As such, there is nothing at front end 130 to prevent a product from moving down top surface 128 and past front end 130.

In accordance with one embodiment, base structure 120 has a width 140 between side walls 106 and 108 of approximately 23.56 inches (59.84 cm) and a depth 142 that is the same as depth 114 of mounting frame 102. In accordance with one embodiment, base structure 120 is constructed of a single piece of material that is bent at curved portion 126 to form base portion 122 and product support portion 124. In accordance with one embodiment, the single piece of material has a substantially uniform thickness 138 of approximately 0.118 inches (0.3 cm) and is constructed of styrene such that both base portion 122 and product support portion 124 have the same thickness. Base structure 120 is attached to side walls 106 and 108, for example by an adhesive.

Figure 3:
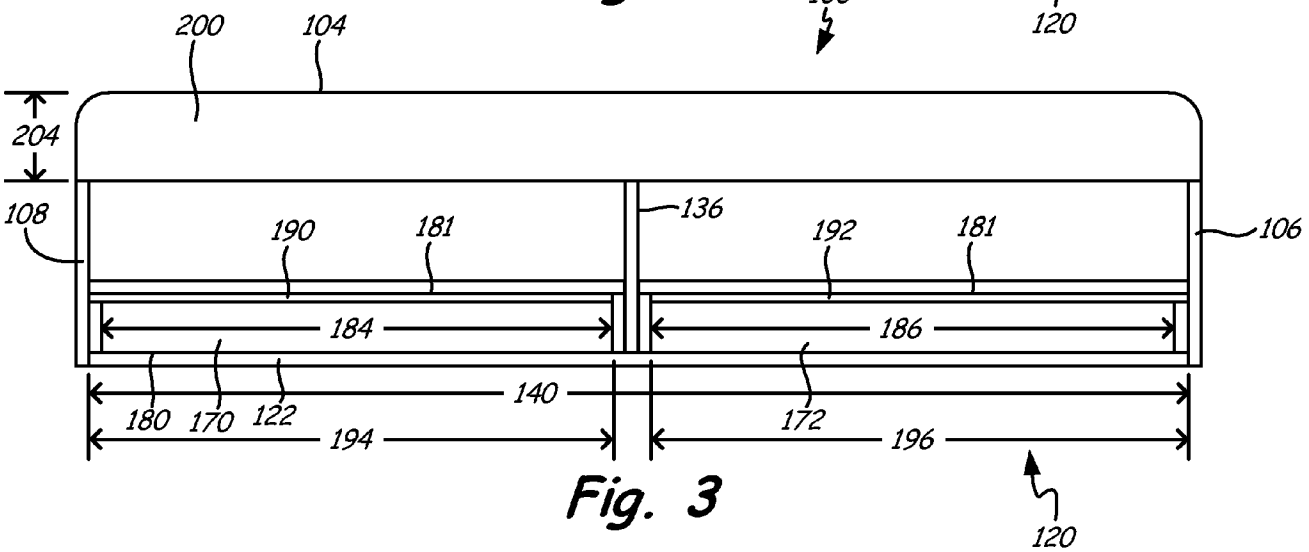
FIG. 3 is a back view of the retail display apparatus of FIG. 1.
Figure 4:
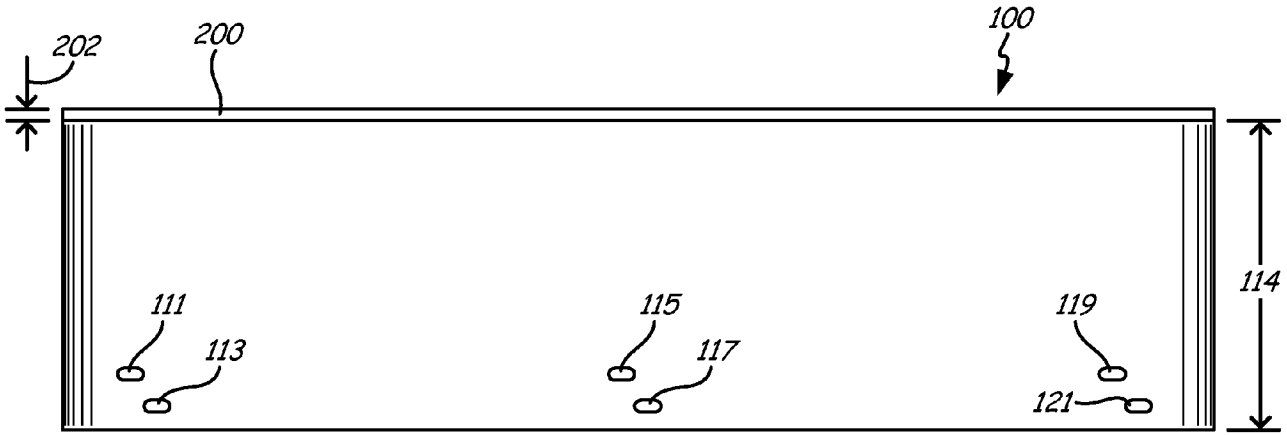
FIG. 4 is a top view of the retail display apparatus of FIG. 1.

A center support wall or interior support 136 extends upward from base portion 122 to a bottom surface 137 of mounting frame 102 through an opening 144 in the product support portion 124. Center support wall 136 has a vertical wall segment 146, a curved segment 148 and a horizontal segment 150. Vertical wall segment 146 extends from base portion 122 to curved segment 148 and horizontal wall segment 150 extends from curved segment 148 and is parallel to and abuts bottom surface 137 of mounting frame 102. In accordance with one embodiment, horizontal wall segment 150 is adhesively attached to bottom surface 137 and a bottom of vertical wall segment 146 is adhesively attached to a top surface 180 of base portion 122 (FIG. 3). In accordance with one embodiment, horizontal wall segment 150 has a length 152 of approximately 0.94 inches (2.39 cm) and vertical wall segment 146 has a height 154 of approximately 7.08 inches (17.98 cm). In accordance with one embodiment, center support wall 136 has a depth 156 of approximately 3.5 inches (8.89 cm). Center support wall 136 has a thickness 141, which in accordance with one embodiment is approximately 0.118 inches (0.3 cm). Opening 144 has a width 143, which in accordance with one embodiment is approximately 0.150 inches (0.38 cm).

Center support wall 136 divides product support portion 124 into two separate inclined planes 161 and 163. Each inclined plane can support a different sample of material.

Center support wall 136 provides both vertical support for base portion 122 to prevent sagging of base portion 122 at its center and lateral support to help reduce lateral sway. Although center support wall 136 is shown as having a same depth as base portion 122 and mounting frame 102, in other embodiments, center support wall 136 may have a smaller depth and in some embodiments may be a post. In embodiments where center support wall 136 has a smaller depth, center support wall may be positioned at some point between the front end 130 and the back end 132 of product support portion 124, may be aligned with front end 130 or may be aligned with back end 132. Further, although center support wall 136 is shown as a single piece, in other embodiments, center support wall 136 may be formed of a plurality of wall pieces that are aligned at a same horizontal position across the retail apparatus.

In addition, although center support wall 136 is shown as being horizontally centered between side walls 106 and 108, in accordance with other embodiments, center support wall 136 may be offset horizontally to one side or the other of the display apparatus. Further, although only a single center support wall is shown, multiple horizontally separated interior support walls are provided in other embodiments.

In accordance with one embodiment, center support wall 136 is made of a single sheet of material that is bent at curved segment 148 to define vertical wall segment 146 and horizontal segment 150. The single sheet of material may be made of styrene, for example.

Figure 6:
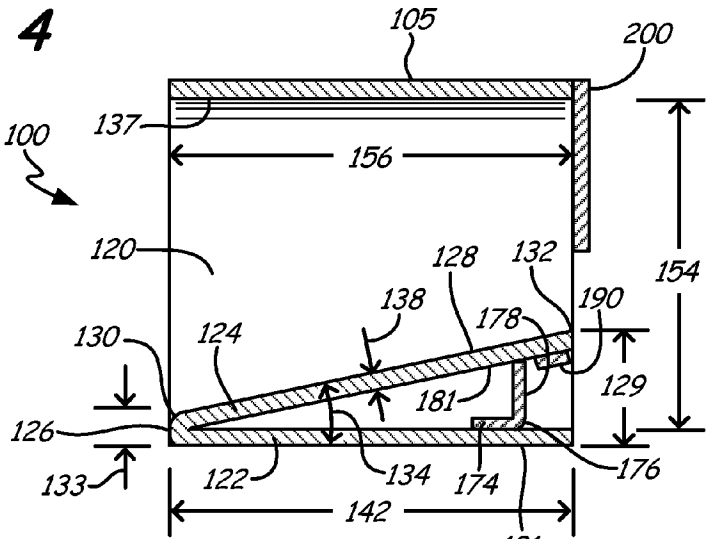
FIG. 6 is a side sectional view of the retail display apparatus of FIG. 1.
Figure 5:
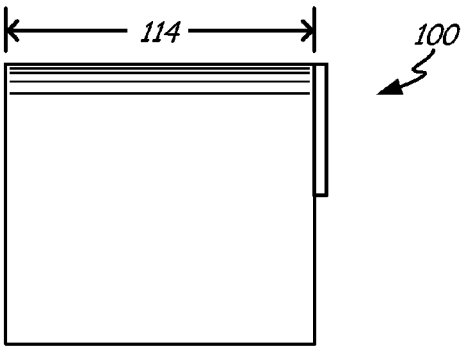
FIG. 5 is a side view of the retail display apparatus of FIG. 1.

Between base portion 122 and product support portion 124 are two angle brackets 170 and 172. Angle bracket 170 has a horizontal segment 174, a curved segment 176 and a vertical segment 178 (FIG. 6). Horizontal segment 174 is parallel to and abuts a top surface 180 of base portion 122. In accordance with one embodiment, horizontal segment 174 is adhesively attached to top surface 180. Vertical segment 178 ends at and is in contact with bottom surface 181 of product support portion 124. In accordance with one embodiment, a top end of vertical segment 178 is adhesively attached to bottom surface 181 of product support portion 124. Angle bracket 172 has a similar structure to angle bracket 170 and is similarly adhered to top surface 180 of base portion 122 and bottom surface 181 of product support portion 124. In accordance with one embodiment, angle bracket 170 has a width 184 of approximately 11.00 inches (27.94 cm) and angle bracket 172 has a width 186 of approximately 11.00 inches (27.94 cm), and angle bracket 170 is separated from angle bracket 172 by center support wall 136. In accordance with one embodiment, horizontal segment 174 has a length of approximately 1 inch (2.54 cm) and vertical segment 178 has a height from top surface 180 to bottom surface 181 of approximately 1 inch (2.54 cm). In accordance with one embodiment, angle brackets 170 and 172 are each formed from a single sheet of material, such as styrene, for example, that is bent to form the horizontal segments and the vertical segments.

Two fastening elements 190 and 192 are attached to bottom surface 181 of product support portion 124. Fastening element 190 is separated from fastening element 192 by center support wall 136. In accordance with one embodiment, fastening elements 190 and 192 are one of a hook or loop material such as Velcro®, which are attached to bottom surface 181 by an adhesive. In accordance with one embodiment, fastening element 190 has a width 194 of approximately 11.44 inches (29.06 cm) and fastening element has a width 196 of approximately 11.44 inches (29.06 cm) inches. Although not shown, fastening elements 190 and 192 have a depth of approximately 0.62 inches (1.57 cm).

Although fastening elements 190 and 192 are shown as single fastening elements, the single fastening elements may each be replaced with multiple separate fastening elements. In addition, although a hook or loop material is shown above, other fasteners such as buttons, snaps, buckles, latches or ties, for example, may be used.

A back plate 200 is attached to a back of top portion 104 and a top portion of the back of side walls 106 and 108. In accordance with one embodiment, back plate 200 has a thickness 202 of approximately 0.118 inches (0.3 cm), a height 204 of approximately 3.12 inches (7.92 cm), and a width of approximately 24.00 inches (60.96 cm). In accordance with one embodiment, back plate 200 is adhesively attached to the back of top portion 104 and the back of side walls 106 and 108. Back plate 200 provides lateral stability to retail apparatus 100 and helps to reduce horizontal sway.

Figure 7:
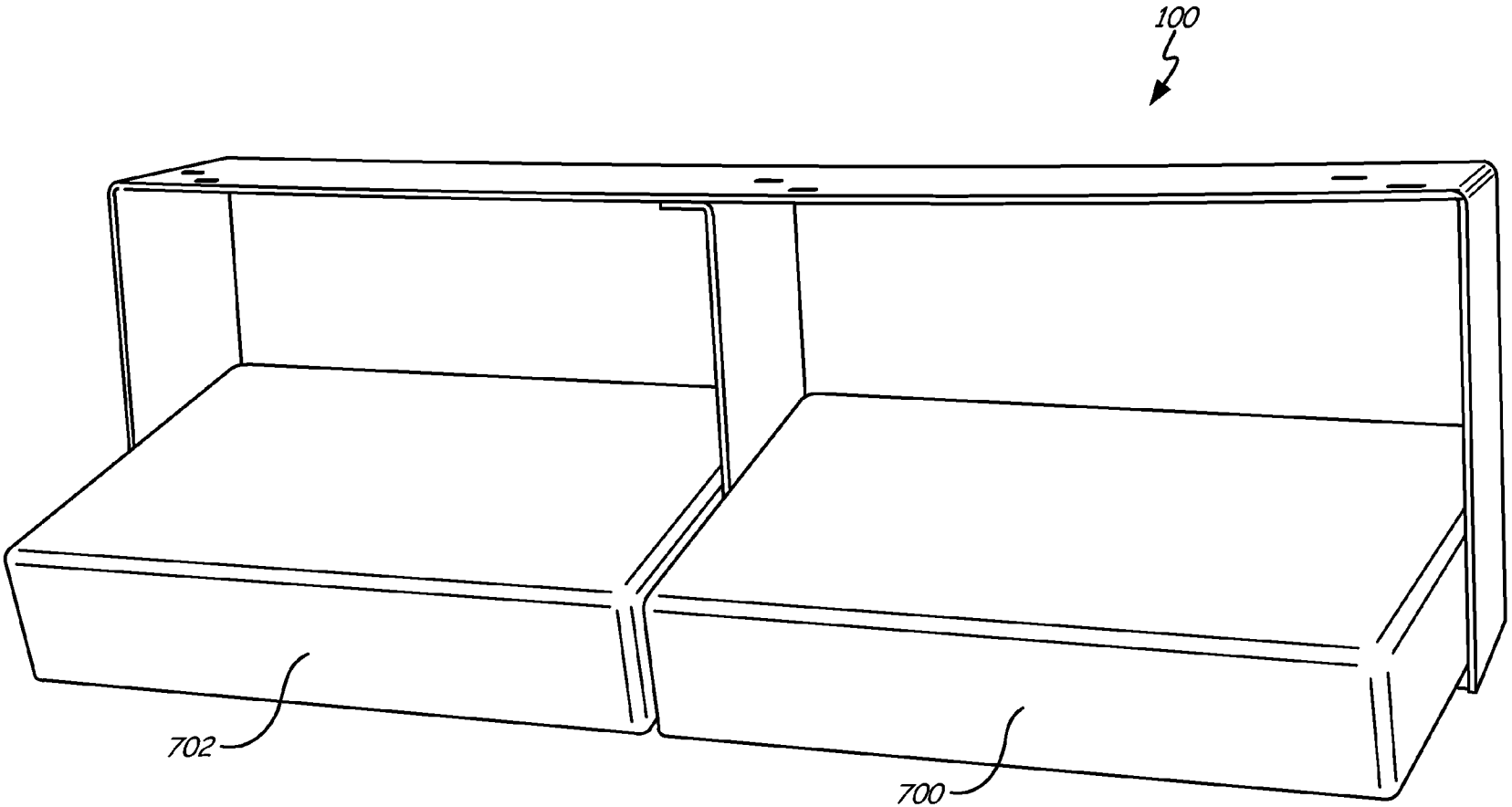
FIG. 7 is a front perspective view of a retail display apparatus supporting samples, in accordance with one embodiment.
Figure 8:
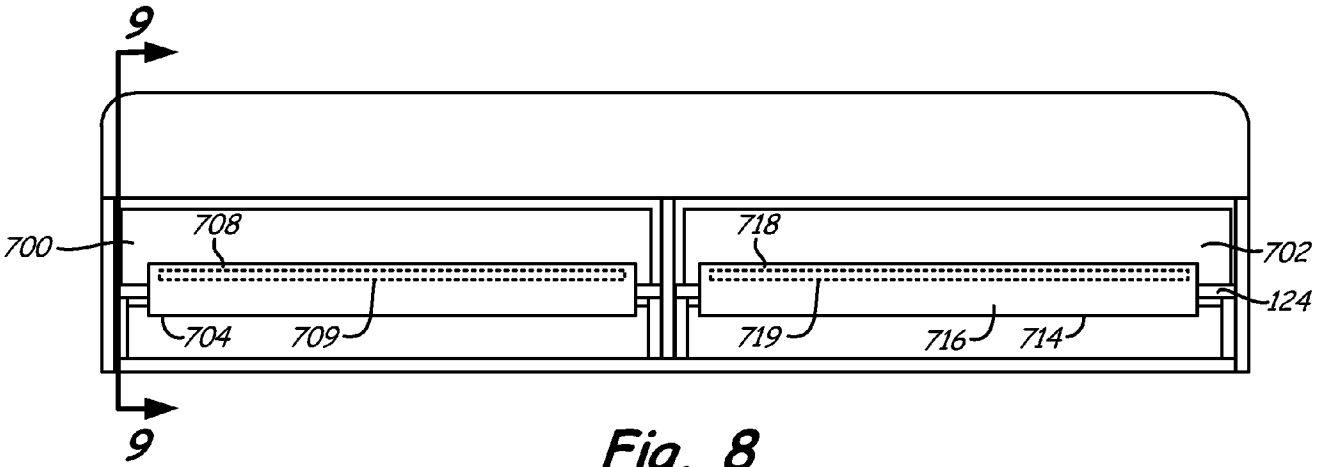
FIG. 8 is a back view of the retail display apparatus of FIG. 7.
Figure 9:
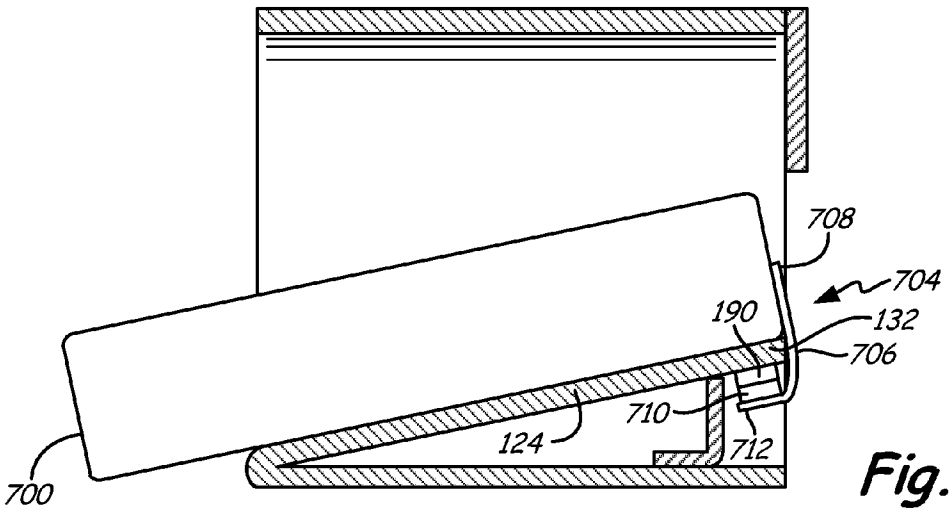
FIG. 9 is a side sectional view of the retail display apparatus of FIG. 7.

FIGS. 7-9 provide a perspective, back and side cross-sectional view, respectively, of the retail display apparatus 100 of FIGS. 1-6 with two product samples 700 and 702 attached to and supported by retail display apparatus 100. Samples 700 and 702 can be samples of foam material such as material used in bedding, for example. In accordance with some embodiments, the foam material is enclosed in a fabric case.

Samples 700 and 702 rest on product support portion 124 and extend past front end 130 of product support portion 124. Sample 700 is attached to product support portion 124 through an attachment mechanism 704 consisting of a fabric extension or fastening strap 706 having a first end 708 sewn to the back of sample 700 by stitching 709 and a second end 712 sewn to a fastening element 710. In accordance with one embodiment, fastening element 710 is a hook or loop material such as Velcro®. Fastening element 710 engages with and is fastened to fastening element 190. Similarly, sample 702 is attached to product support portion 124 through an attachment mechanism 714 consisting of a fabric extension or fastening strap 716 having a first end 718 sewn to the back of sample 702 by stitching 719 and second end sewn to a fastening element (not shown). The fastening element on the second end of fabric extension 716 engages with and is fastened to fastening element 192 (FIG. 3). The fastening straps 706 and 716 extend around back end 132 of top panel 124. Samples 700 and 702 are separated by interior support 136.

Figure 10:
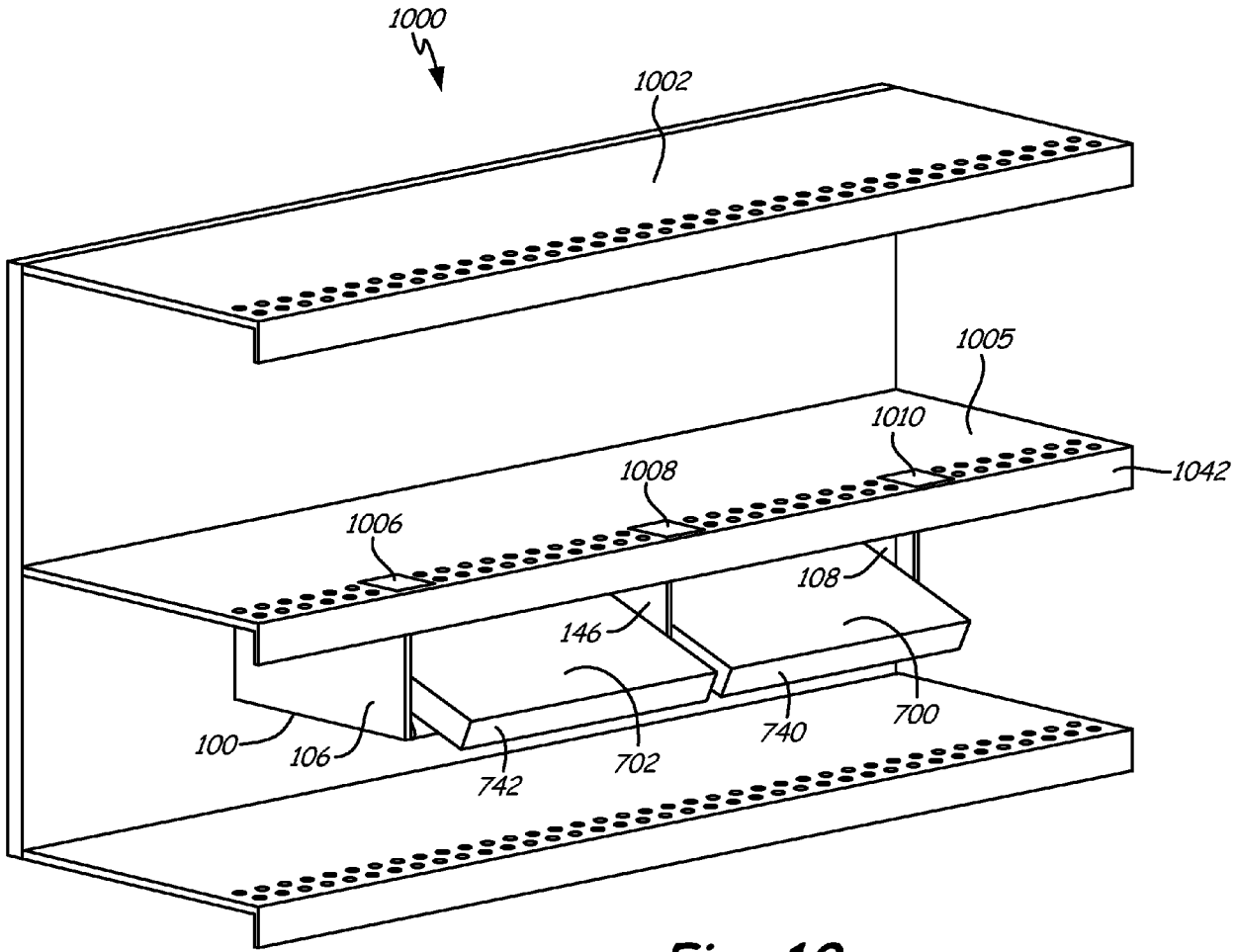
FIG. 10 is a front perspective view of a retail display unit.
Figure 11:
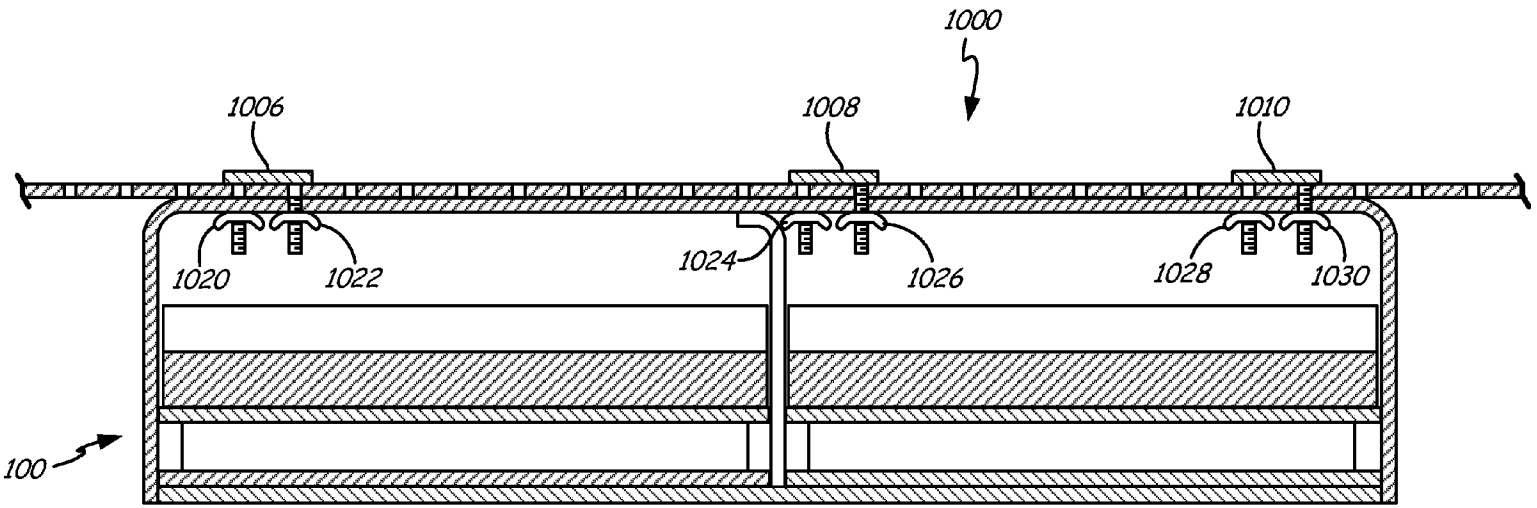
FIG. 11 is a front sectional view of a portion of the retail display unit of FIG. 10.
Figure 12:
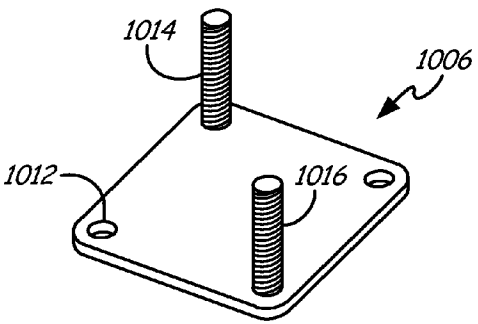
FIG. 12 is a perspective view of a fastener, in accordance with one embodiment.

FIGS. 10 and 11 show a perspective and front cross-sectional view, respectively, of a retail display unit 1000 that includes retail display structure 100 mounted to a shelving unit 1002. Retail display structure 100 is mounted to a shelf 1005 of shelving unit 1002, by fasteners 1006, 1008 and 1010. FIG. 12 is a perspective view of fastener 1006 showing that fastener 1006 includes a plate 1012 and two threaded posts 1014 and 1016, which extend from one side of plate 1012. In accordance with one embodiment, threaded posts 1014 and 1016 are welded to plate 1012 and are diagonally positioned on plate 1012 such that they are positioned near diagonally opposing corners of plate 1012. Fasteners 1008 and 1010 are similar to fastener 1006. Fasteners 1006, 1008 and 1010 further include wing nuts 1020, 1022, 1024, 1026, 1028 and 1030. Retail display structure 100 is mounted to shelf 1006 by inserting the threaded posts of fasteners 1006, 1008 and 1010 through holes in shelf 1005 and holes 111, 113, 115, 117, 119, and 121 in retail display structure 100. Wing nuts 1020, 1022, 1024, 1026, 1028 and 1030 are then screwed onto the threaded posts to bring the top of retail display structure 100 into contact with the bottom surface of shelf 1005.

As shown in FIG. 10, side walls 106 and 108 and center support wall 136 of retail display structure 100 extend directly below the top portion of retail display structure 100 such that the entirety of retail display structure 100 is directly below shelf 1005. However, because samples 700 and 702 extend past front end 130 of retail display structure 100, samples 700 and 702 extend past a front edge 1042 of shelf 1005. This gives guests access to samples 700 and 702 without bringing the guests into contact with retail display structure 100.

Retail display structure 100 may be mounted to any raised shelf in a shelving unit that it can fit beneath. However, in accordance with many embodiments, retail display structure 100 is mounted on shelves such that samples 700 and 702 are at a height from the floor that makes it easy for guests to both see and feel the samples. Retail display structure 100 may also be mounted to various other horizontal positions along a shelf.

Although examples have been given above with specific dimensions, those skilled in the art will recognize that not all of the embodiments will have these dimensions. Also, in the discussion above, relative placement terms such as horizontal, vertical, above and below have been used. Those skilled in the art will recognize that these terms are intended to describe the relative placement of items when the retail display structure 100 is mounted beneath a shelf in its normal and expected orientation.

In accordance with several embodiments, samples are displayed by mounting holder 100 to a bottom of shelf 1005 by passing portions of mounting fasteners 1006, 1008, and 1010 through holes in holder 100 and holes in shelf 1005. Samples 700 and 702 are placed on inclined planes 161 and 163, which are separated by center support wall 136, such that front 740 and 742 of samples 700 and 702 extend past a front 130 of holder 100. The samples 700 and 702 are attached to holder 100 by engaging a fastener 190 positioned on a bottom surface 181 of the inclined plane with a fastener 710 positioned on an end of a strap 706 connected to the sample.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a shelving unit with at least one shelf, the shelf having a top surface and a bottom surface with at least one opening between the top surface and the bottom surface;

an attachment structure having a top portion and two side portions extending down from the top portion so that the two side portions are below the shelf, the attachment structure is mounted to the bottom surface of the shelf by at least one fastener passing through at least one of the openings in the shelf;

a product support structure positioned between the two side portions of the attachment structure and having a top panel with a front end and a back end wherein the front end of the top panel is lower than the back end of the top panel and wherein the front end of the top panel is unobstructed;

wherein the top panel comprises a top surface and a bottom surface and wherein at least one fastener is attached to the bottom surface of the top panel at the back end of the top panel; and a first product sample positioned on the top surface of the top panel and a fastening strap connected to the product sample, the fastening strap extending around the back end of the top panel and a fastener on the fastening strap engaging the fastener on the bottom surface of the top panel.

2. The retail display unit of claim 1 wherein the product support structure further comprises a bottom panel located below the top panel and a curved portion positioned between the top panel and the bottom panel at the front end of the top panel.

3. The retail display unit of claim 2 further comprising a bracket located between the bottom panel and the top panel of the product support structure, the bracket contacting both the bottom panel and the top panel.

4. The retail display unit of claim 2 further comprising an interior support extending from the bottom panel to a bottom surface of the top portion of the attachment structure, the interior support passing through an opening in the top panel.

5. The retail display unit of claim 1 wherein the first product sample extends past the front end of the top panel.

6. The retail display unit of claim 1 further comprising a second product sample positioned on the top surface of the top panel and a second fastening strap connected to the second product sample, the second fastening strap extending around the back end of the top panel.

7. The retail display unit of claim 6 further comprising an interior support extending from the bottom panel to a bottom surface of the top portion of the attachment structure, the interior support passing through an opening in the top panel such that the first product sample and the second product sample are separated by the interior support.

8. In combination, a retail display unit and a product comprising:

a shelf having a bottom surface;

a mounting frame having a mounting surface adapted to mount to the bottom surface of the shelf and having at least two sidewalls extending from the mounting surface;

a product support portion positioned between the at least two side walls of the mounting frame, the product support portion having a top surface and a bottom surface that are oriented at an angle relative to the mounting surface of the mounting frame;

a first fastening element attached to the bottom surface of the product support portion; and a second fastening element attached to a back of the product that is being supported on the product support portion, the second fastening element being engaged with the first fastening element.

9. The retail display unit of claim 8 wherein the product support portion is part of a base structure, the base structure comprising a base portion, the product support portion and a curved portion between the base portion and the product support portion, wherein the product support portion is positioned between the base portion and the mounting surface.

10. The retail display unit of claim 9 wherein the base portion has a bottom surface that is substantially parallel to the mounting surface.

11. The retail display unit of claim 9 wherein the first fastening element is between the base portion and the product support portion.

12. The retail display unit of claim 9 further comprising an angle bracket having a first portion in contact with the base portion and a second portion in contact with the bottom surface of the product support portion.

13. The retail display unit of claim 9 further comprising a center support wall extending from the base portion to the mounting frame through an opening in the product support portion.

14. The retail display unit of claim 9 further comprising a back panel attached to the mounting frame along portions of both of the two side walls.

* * * * *